US009885366B2

(12) United States Patent
Gajewski

(10) Patent No.: US 9,885,366 B2
(45) **Date of Patent: *Feb. 6, 2018**

(54) CEILING FAN HAVING A SINGLE FAN BLADE

(71) Applicant: MINKA LIGHTING, INC., Corona, CA (US)

(72) Inventor: Mark Gajewski, Avila Beach, CA (US)

(73) Assignee: Minka Lighting, Inc., Corona, CA (US)

( * ) Notice: Subject to any disclaimer, the term of this patent is extended or adjusted under 35 U.S.C. 154(b) by 313 days.

This patent is subject to a terminal disclaimer.

(21) Appl. No.: 14/671,748

(22) Filed: Mar. 27, 2015

(65) Prior Publication Data

US 2015/0204346 A1 Jul. 23, 2015

Related U.S. Application Data

(63) Continuation of application No. 12/986,908, filed on Jan. 7, 2011, now Pat. No. 9,004,863.

(51) Int. Cl.

| | |
|---|---|
| ***F04D 29/38*** | (2006.01) |
| ***F04D 25/08*** | (2006.01) |
| ***F04D 29/64*** | (2006.01) |
| ***F04D 29/34*** | (2006.01) |
| ***F04D 29/66*** | (2006.01) |
| ***F04D 29/32*** | (2006.01) |

(52) U.S. Cl.

CPC ..... *F04D 29/384* (2013.01); *F04D 25/088* (2013.01); *F04D 29/329* (2013.01); *F04D 29/34* (2013.01); *F04D 29/646* (2013.01); *F04D 29/662* (2013.01)

(58) Field of Classification Search

CPC ..... F04D 25/088

See application file for complete search history.

(56) References Cited

U.S. PATENT DOCUMENTS

| | | | | |
|---|---|---|---|---|
| 1,870,342 | A | 8/1932 | Munk | |
| 4,884,947 | A | 12/1989 | Rezek | |
| 6,149,388 | A | 11/2000 | Liao | |
| 6,155,786 | A | 12/2000 | Blateri et al. | |
| 6,382,917 | B1 | 5/2002 | Zuege | |
| D510,763 | S * | 10/2005 | Da Costa | D23/377 |
| 7,481,626 | B2 * | 1/2009 | Gajewski | F04D 25/088 416/204 R |
| 7,507,151 | B1 | 3/2009 | Parker et al. | |
| D678,997 | S * | 3/2013 | Gajewski | D23/372 |
| 2009/0053059 | A1 | 2/2009 | Lung-Fa | |

* cited by examiner

*Primary Examiner* — Woody Lee, Jr.
*Assistant Examiner* — Brian O Peters
(74) *Attorney, Agent, or Firm* — Baker & McKenzie LLP

(57) ABSTRACT

A ceiling fan including a motor having a rotating flange; a single integrally formed fan blade, wherein the fan blade includes two substantially equally weighted wing portions disposed opposite each other; and a center portion disposed between and integrally formed with the two wing portions and having a passageway therethrough, wherein the passageway is sized such that the fan motor fits at least partially within the passageway; and means for attaching the center portion of the fan blade to the rotating flange of the motor is provided.

18 Claims, 3 Drawing Sheets

CEILING FAN HAVING A SINGLE FAN BLADE

CROSS REFERENCE TO RELATED APPLICATIONS

This application is a continuation of U.S. application Ser. No. 12/986,908, filed Jan. 7, 2011. The contents of said application are hereby incorporated in their entirety by reference.

FIELD OF THE INVENTION

This invention relates to a ceiling fan having a single fan blade having an integral central portion which functions as a motor housing.

BACKGROUND OF THE INVENTION

Ceiling fans typically include a motor having a rotating flange which rotates about an axis that is collinear with a downrod by which the fan is attached to the ceiling. The fan motor is typically encased in a motor housing which wraps about the motor while leaving partial access to the rotating flange. Such partial access to the rotating flange is required so that the fan blades may be attached to the rotating flange. The requirement of a partial access often leads to an increase in the heat, vibration and noise into the surrounding environment. Furthermore, a partial access may subject the internal components to premature failure in environments that are high in salinity, humidity, or dust (e.g., due to rusting, corrosion, or seizing). Commercially available ceiling fans include numerous examples in which the fan blades are attached to the rotating flange by use of blade irons. Other known ceiling fans use means for attaching the fan blades directly to the rotating flange without the use of blade irons.

In both types of known ceiling fans, the motor, including the motor housing, is first suspended from the ceiling. The ceiling fan installer may then attach the blade irons, either separately or in a blade iron and blade combination. Alternatively, the ceiling fan installer may attach the fan blades directly to the rotating flange. In any event, the ceiling fan installer must work in an uncomfortable position, generally screwing fasteners into the rotating flange from underneath the ceiling fan motor to install multiple numbers of ceiling fan blade irons and/or blade combinations.

Further, both types of known ceiling fans require multiples of fan blade irons and blade combinations. This often leads to fasteners such as screws wearing out or corroding over time, thus potentially causing a safety hazard as a fan blade can become detached from the rest of the ceiling fan during use. This is also true for other mechanisms or devices other than screws used to secure fan blades to the ceiling fan. For example, U.S. Pat. No. 6,149,388 discloses the use of a collar having recessed sectors and protrusions to prevent disengagement from the ceiling fan Like other fan blade irons, the collar system is also subject to wearing out and corrosion over time.

The requirement for multiples of fan blade irons and blade combinations also leads to an imbalance of the entire ceiling fan during operation, and the ceiling fan must often be adjusted by the use of fan blade weights of various measures. This can be a time-consuming process for the ceiling fan installer to properly correct the imbalance. U.S. Pat. No. 6,364,612 discloses the use of springs fitted onto the vanes (e.g., fan blade irons) to absorb the swinging force of the ceiling fan to correct the imbalance. However, use over a period of time will eventually cause such springs to wear out and result in the ceiling fan operating in an imbalanced state.

In addition, the use of motor housings to conceal the fan motor results in a need to mold or otherwise manufacture an additional item(s) and in additional assembly time for the manufacturer and/or ceiling fan installer. Use of additional items can increase materials having differing weights and densities. These differences can result in an unbalanced or imbalanced ceiling fan during operation as described above, thus necessitating the use of fan blade weights. These needs may result in additional expenditure of resources such as time, materials, and cost.

SUMMARY OF THE INVENTION

A first aspect of the invention provides a ceiling fan comprising a motor having a rotating flange; a single integrally formed fan blade comprising two substantially equally weighted wing portions disposed opposite each other and a center portion disposed between and integrally formed with the two wing portions and having passageway therethrough, wherein the passageway is sized such that the fan motor fits at least partially within the passageway; and means for attaching the center portion of the fan blade to the rotating flange of the motor. In some embodiments, the wing portions present substantially equal air movement and balanced rotation.

In one specific embodiment, the ceiling fan further comprises a light kit disposed below the passageway. In some embodiments, the ceiling fan further includes a cap disposed above the passageway.

In certain embodiments, the wing portions of the fan blade each exhibit a twist.

In some embodiments of the invention, the means for attaching the center portion of the fan blade to the rotating flange of the motor comprises a plurality of fastener openings and a plurality of alignment indentations on the rotating flange; a ring comprising a plurality of fastener openings and a plurality of alignment posts, wherein the fastener openings of the ring align with the fastener openings of the rotating flange and the alignment posts of the ring mate with the alignment indentations of the rotating flange wherein the ring further comprises means to attach the center portion of the fan blade with the ring.

In some embodiments of the invention, the center portion of the fan blade further comprises a plurality of extensions extending radially inwardly wherein each extension includes a fastener opening.

Yet another aspect of the invention provides a ceiling fan comprising a motor having a rotating flange; a single integrally formed fan blade comprising two substantially equally weighted wing portions disposed opposite each other and a center portion disposed between and integrally formed with the two wing portions and having a passageway therethrough, wherein the passageway is sized such that the fan motor fits at least partially within the passageway; and means for attaching the center portion of the fan blade to the rotating flange of the motor.

Yet another aspect of the invention provides a ceiling fan comprising a motor having a rotating flange; a single integrally formed fan blade comprising two substantially equally weighted wing portions disposed opposite each other and a center portion disposed between and integrally formed with the two wing portions and having a passageway therethrough, wherein the passageway is sized such that the fan motor fits at least partially within the passageway; means for attaching the center portion of the fan blade to the rotating flange of the motor; and a light kit.

DESCRIPTION OF THE PREFERRED EMBODIMENTS

Figure 1:
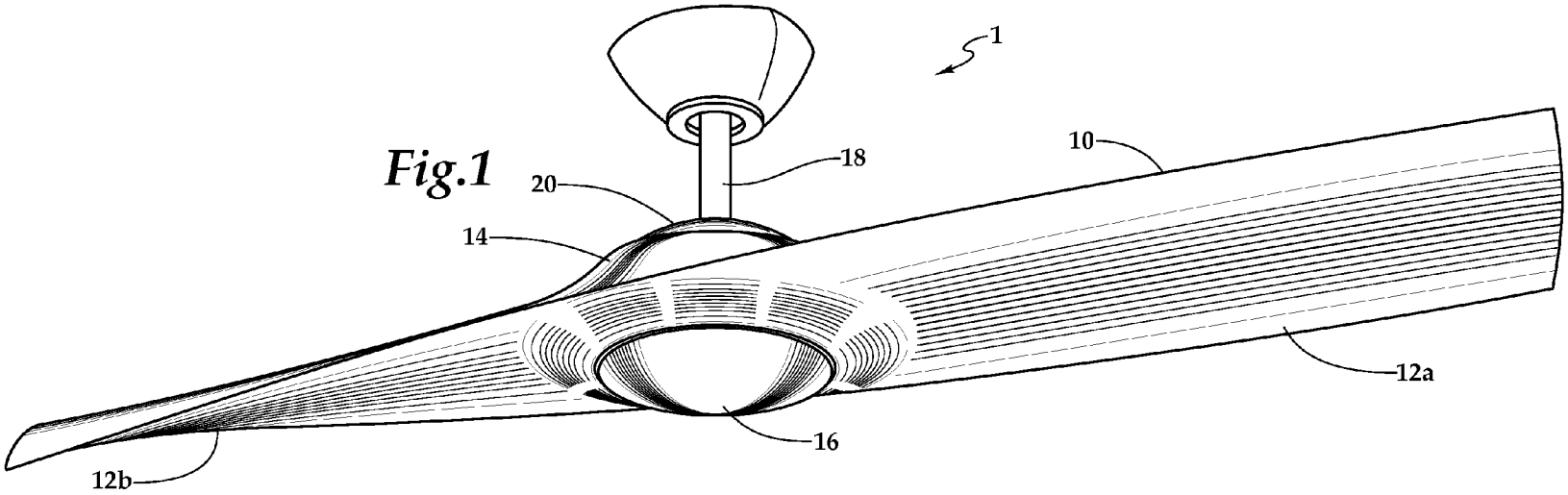
FIG. 1 is a perspective view of a first embodiment of a single-blade ceiling fan of the invention.

FIG. 1 illustrates a first embodiment of the inventive ceiling fan 1. The embodiment illustrated in FIG. 1 includes a single integrally formed fan blade 10. The single integrally formed fan blade 10 includes two opposing wing portions 12*a* and 12*b* and a center portion 14. Center portion 14 partially encloses the fan motor (not shown in FIG. 1). A light kit 16 is attached to the ceiling fan and is located below the center portion 14. In alternative embodiments, a cover plate (not shown) may be used in lieu of a light kit. A downrod 18 suspends the ceiling fan 1 from the ceiling. Any of a number of known ceiling connectors may be used to suspend the downrod 18 from a ceiling junction box or electrical connection point. The downrod defines an axis of rotation about which the fan motor rotates. Wing portions 12*a* and 12*b* extend radially outward from the axis of rotation. In the embodiment shown in FIG. 1, the wing portions 12*a* and 12*b* exhibit a twist, or change in blade angle of attack, along the length of the wing portions 12*a* and 12*b*. The twist shown in FIG. 1, however, is illustrative and not limiting of the invention. Alternative twists, sizes, and shapes of wing portions 12*a* and 12*b* are contemplated in this invention, provided that wing portions 12*a* and 12*b* are substantially equally weighted and configured to present substantially balanced air movement and rotation. For example, in one alternative embodiment, wing portions 12*a* and 12*b* may be flat, exhibiting no twist. Referring still to FIG. 1, placed above center portion 14 is a cap 20.

Figure 4:
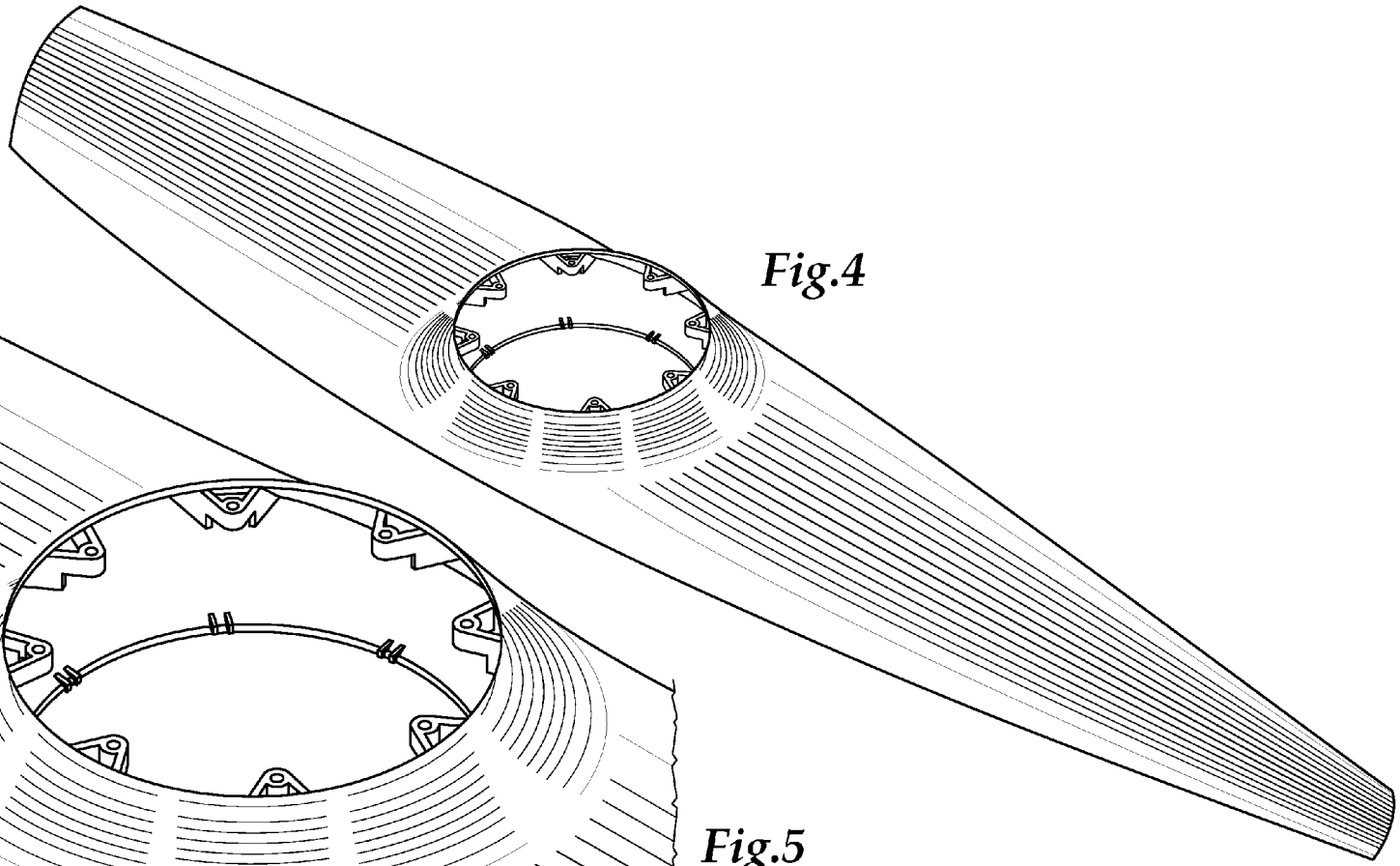
FIG. 4 is an elevated perspective view of a first embodiment of a single integrated ceiling fan blade useful in the invention.
Figure 5:
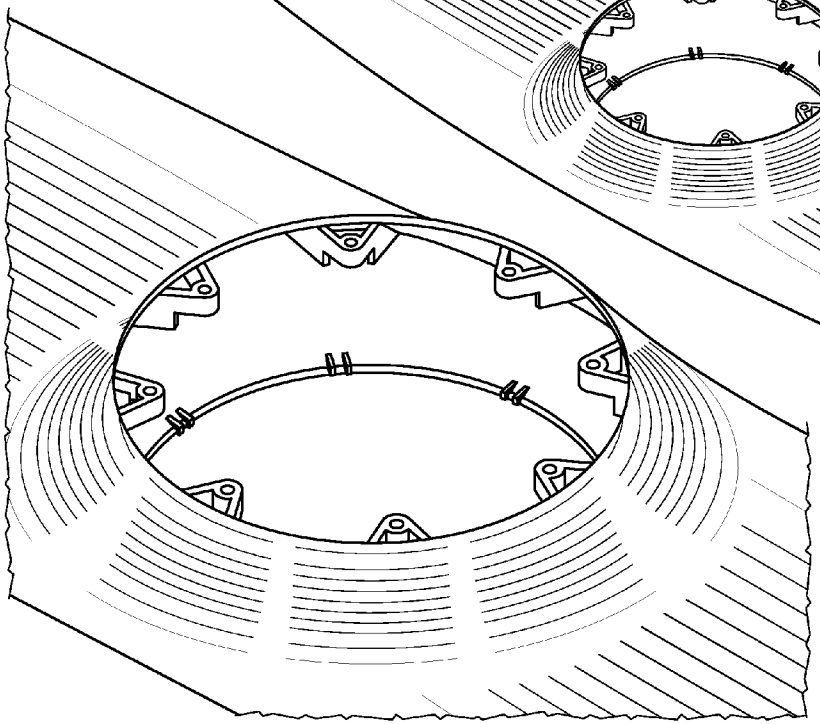
FIG. 5 is an elevated perspective view of the central portion of the fan blade shown in FIG. 4.
Figure 6:
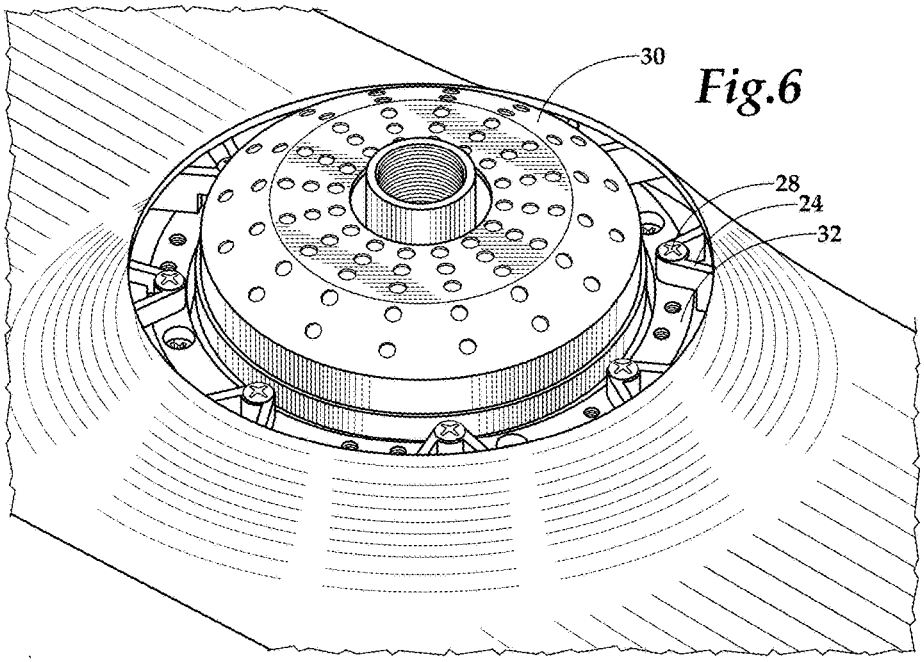
FIG. 6 is an elevated perspective view of the central portion of the fan blade of FIG. 4 attached to the fan motor and attachment ring combination shown in FIG. 3.

FIG. 4 illustrates fan blade 10. As seen in FIG. 4, the center portion 14 of fan blade 10 includes a top layer 14*a* and a bottom layer 14*b*. Layer 14*a* extends upwardly from the top surface of fan blade 10 and layer 14*b* extends downwardly from the bottom of fan blade 10. Center portion 14 further includes an open passageway 22, the height of which is defined by the distance between layers 14*a* and 14*b*. Passageway 22 is formed by a circular opening in layer 14*a* which lies apart from and over a circular opening in layer 14*b*. In preferred embodiments, the height of passageway 22 is sufficient to substantially enclose a fan motor. FIG. 5 illustrates the center portion 14 of fan blade 10. Extending radially inward to passageway 22 from layer 14*a* are projections 24. Projections 24 include fastener openings 26. As shown in FIG. 6, screws 28 (or other appropriate fasteners) may be passed through fastener openings 26 to attach fan blade 10 onto a fan motor 30 or attachment ring 32 which is, in turn, attached to fan motor 30. In some embodiments of the inventive ceiling fan, the entire fan blade 10 is made of a top and a bottom surface joined along all edges except at the interior edges of passageway 22. In other embodiments, wing portions 12*a* and 12*b* may be formed from a single ply or layer of material to which a second ply is bonded at the center portion 14 permitting the formation of passageway 22.

Figure 2:
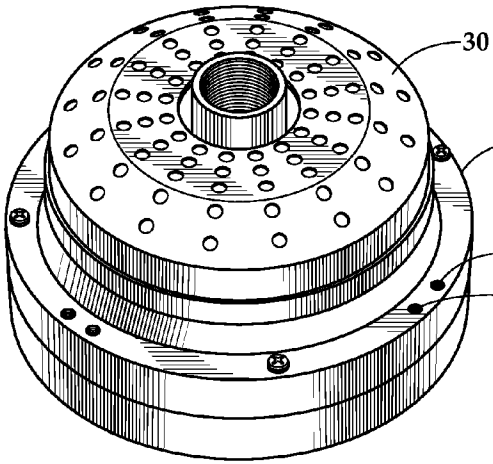
FIG. 2 is a perspective view of a first embodiment of a fan motor useful in the invention.
Figure 3:
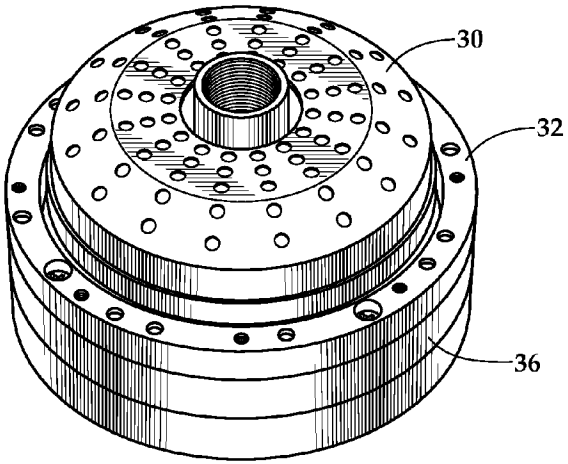
FIG. 3 is a perspective view of the fan motor of FIG. 2 in combination with an attachment ring.
Figure 7:
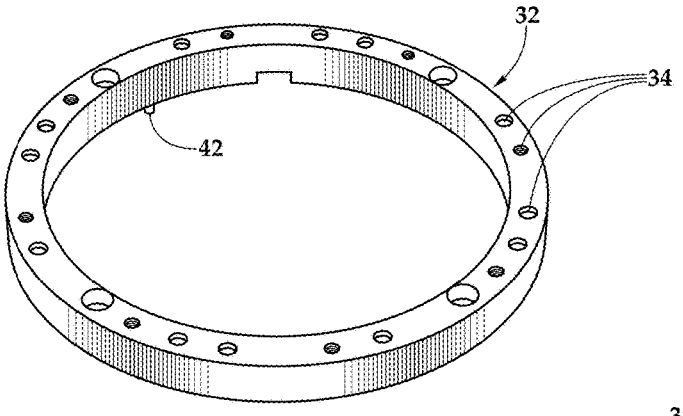
FIG. 7 is an elevated perspective view of an embodiment of an attachment ring useful in the invention.
Figure 8:
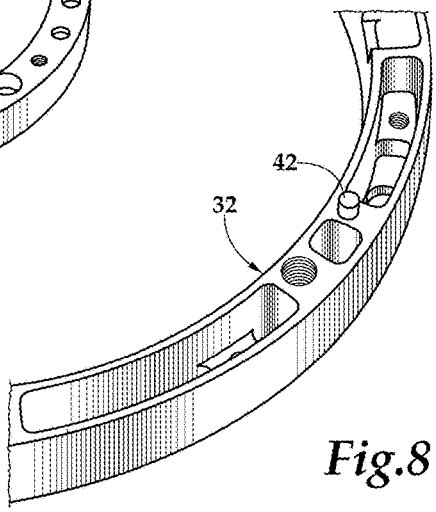
FIG. 8 is a perspective view of a portion of the bottom side of the attachment ring shown in FIG. 7.

FIG. 7 illustrate an attachment ring 32 which may be used in certain embodiments of the invention. FIG. 7 is an elevated perspective view showing the top surface of the ring having a number of spaced holes 34 of varying size and configuration. FIG. 2 illustrates a fan motor 30 having a rotating flange 36 which also includes a plurality of fastener openings 38 configured to receive screws or other appropriate fasteners. Rotating flange 36 further includes guide indentations 40 configured to receive guide posts (not shown in FIG. 2.) FIG. 8 illustrates a portion of a bottom side of ring 32. The bottom side of ring 32 includes guide posts 42 configured to interconnect with guide indentations 40 on rotating flange 36. FIG. 3 illustrates a fan motor 30 having a rotating flange 36 onto which ring 32 has been attached.

Referring again to FIG. 6, a fan motor 10 having a rotating flange (not visible in FIG. 6) onto which ring 32 has been attached is shown. Further shown in FIG. 6 is the attachment of fan blade 10 onto ring 32 (and thereby the rotating flange) by threading a screw 28 through each fastener opening 26 into an appropriate opening in ring 32. In alternative embodiments, fan blade 10 may be attached directly to rotating flange 36 without the use of a ring. Although screws 28 are illustrated as attaching fan blade 10 to ring 32, it will be understood that other means for such attachment may be used. For example, center portion 14 could include downwardly projecting, contractable clips that would interlock with interlocking receiving members on the rotating flange or ring. In yet other embodiments, the means for attaching the center portion 14 of fan blade 10 onto the rotating flange, either directly or by attachment to a ring, may include hook and loop fasteners, adhesives, such as epoxy, rivets, cotter pins, and magnets. Once attached, fan blade 10 will rotate with the rotation of rotating flange 26.

In the embodiment shown in FIG. 6, a cap may be placed over the passageway 22. An example of a cap 20 having a conelike shape is shown in FIG. 1. In alternative embodiments, cap 20 may have other shapes, such as a hemispheroid, ovoid, or polyhedral.

The illustrated embodiments show the fan blade attachment means attaching to an upper surface of the rotating flange. However, in alternative embodiments, the fan blade attachment means may attach to a bottom and/or side surface of the rotating flange.

What is claimed is:

1. A ceiling fan comprising:

a monolithic fan blade including:

a center portion having a top portion, a bottom portion, and an open passageway extending from the top portion to the bottom portion;

a first wing portion extending from the center portion, an annular sector of a transition from the bottom portion to the first wing portion being concave;

a second wing portion extending from the center portion, an annular sector of a transition from the bottom portion to the second wing portion being concave;

a fan motor disposed at least partially within the open passageway of the center portion of the fan blade; and a ring disposed at least partially within the open passageway of the center portion of the fan blade, the ring secured to both the fan motor and the center portion of the fan blade.

2. The ceiling fan of claim 1, wherein the fan motor is coupled to a down rod.

3. The ceiling fan of claim 1, wherein the ring is secured to a plurality of extensions extending radially inwardly from the center portion of the fan blade.

4. The ceiling fan of claim 1, wherein a top portion and a bottom portion of the first wing portion join at an outer edge of the first wing portion.

5. The ceiling fan of claim 1, wherein a top portion and a bottom portion of the second wing portion join at an outer edge of the second wing portion.

6. The ceiling fan of claim 1, wherein the first wing portion and the second wing portion are disposed opposite to one another relative to the center portion.

7. The ceiling fan of claim 1, wherein the first wing portion and the second wing portion each include a twist.

8. The ceiling fan of claim 1, further comprising a light kit disposed below the open passageway of the center portion.

9. The ceiling fan of claim 1, further comprising a cap disposed above the open passageway of the center portion.

10. The ceiling fan of claim 1, wherein the center portion of the monolithic fan blade further comprises a plurality of extensions extending radially inwardly, wherein each extension comprises a fastener opening.

11. The ceiling fan of claim 1, wherein the ring is secured to the fan motor at a rotating flange of the fan motor.

12. The ceiling fan of claim 11, wherein the rotating flange of the fan motor comprises a plurality of fastener openings and a plurality of alignment indentations.

13. The ceiling fan of claim 1, wherein the ring comprises a plurality of fastener openings and a plurality of alignment posts.

14. A monolithic fan blade comprising:

a center portion having a top portion, a bottom portion, and an open passageway extending from the top portion to the bottom portion;

a first wing portion extending from the center portion, an annular sector of a transition from the bottom portion to the first wing portion being concave;

a second wing portion extending from the center portion, an annular sector of a transition from the bottom portion to the second wing portion being concave; and a fan motor disposed at least partially within the open passageway of the center portion of the fan blade.

15. The monolithic fan blade of claim 14, wherein the fan motor is coupled to a down rod.

16. The monolithic fan blade of claim 14, further comprising a plurality of extensions extending radially inwardly from the center portion, wherein each extension includes a fastener opening.

17. The monolithic fan blade of claim 14, further comprising a removable ring disposed at least partially within the open passageway of the center portion of the fan blade, the removable ring operable to couple to both the fan motor and the center portion of the fan blade.

18. The monolithic fan blade of claim 17, wherein the removable ring is secured to a plurality of extensions extending radially inwardly from the center portion of the fan blade.

* * * * *